US007124962B1

(12) United States Patent
Fryan et al.

(10) Patent No.: US 7,124,962 B1
(45) Date of Patent: Oct. 24, 2006

(54) SPRAYER FOR CLEANING EXTERIOR SURFACES

(75) Inventors: Michael C. Fryan, Racine, WI (US); Peter M. Neumann, Racine, WI (US); Evan A. Sparks, Madison, WI (US); Kevin L. Askling, Madison, WI (US); Loretta G. Lynch, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 11/136,635

(22) Filed: May 24, 2005

(51) Int. Cl.
*B05B 7/30* (2006.01)
*B05B 1/30* (2006.01)
*B05B 7/26* (2006.01)
*B05B 7/28* (2006.01)

(52) U.S. Cl. ..... 239/318; 239/581.1; 239/375; 239/575; 239/394; 239/315; 239/444

(58) Field of Classification Search ..... 239/318, 239/581.1, 375, 575, 394, 315, 444, 302, 239/303, 305, 310, 312, 317, 340, 353, 354, 239/390, 392, 396, 398, 407, 414, 415, 416.2, 239/443–446, 525, 526, 569, 590; 137/268; 222/190

See application file for complete search history.

(56) References Cited

U.S. PATENT DOCUMENTS

| | | | | |
|---|---|---|---|---|
| 2,989,242 A | | 6/1961 | Turak | |
| D191,686 S | | 10/1961 | Johnson | |
| 3,039,492 A | | 6/1962 | Brucker | |
| 3,770,205 A | | 11/1973 | Proctor et al. | |
| 3,940,069 A | * | 2/1976 | Gunzel et al. | 239/318 |
| 4,126,401 A | | 11/1978 | Stoyshin | |
| 4,369,921 A | | 1/1983 | Beiswenger et al. | |
| 4,903,897 A | * | 2/1990 | Hayes | 239/394 |
| 4,966,481 A | | 10/1990 | Satten et al. | |
| 4,969,603 A | * | 11/1990 | Norman | 239/318 |
| 5,100,059 A | * | 3/1992 | Englhard et al. | 239/310 |
| 5,213,264 A | * | 5/1993 | Styne | 239/309 |
| 5,213,265 A | * | 5/1993 | Englhard et al. | 239/310 |
| 5,332,158 A | * | 7/1994 | Styne et al. | 239/310 |

(Continued)

FOREIGN PATENT DOCUMENTS

| | | |
|---|---|---|
| WO | WO 97/48927 | 12/1997 |

OTHER PUBLICATIONS 2 pages dated Apr. 26, 2005 showing a Proctor & Gamble vehicle cleaning sprayer.

(Continued)

*Primary Examiner*—Dinh Q Nguyen
*Assistant Examiner*—Darren Gorman

(57) ABSTRACT

A sprayer is disclosed that may be attached to a garden hose for cleaning exterior surfaces such as windows. By turning a flow selector in a single direction tap water from the hose first flows through the sprayer to rinse the surface to be cleaned. The flow selector can then be set to spray a mixture of cleaner (e.g., one or more surfactants) and surface modifier (e.g., one or more polymers) and water on the surface. The flow selector can then be set to an off position to allow for scrubbing of the surface with a scrubbing tool. The flow selector can then be set to rinse the surface with untreated water, and the flow selector can be turned further to rinse the surface with filtered tap water produced by a filter in the sprayer. Also disclosed are unitary cartridges providing a combined replacement of the cleaning surfactant and a filtering system for deionizing the water.

14 Claims, 13 Drawing Sheets

U.S. PATENT DOCUMENTS

| | | | | |
|---|---|---|---|---|
| 5,850,973 | A * | 12/1998 | Liljeqvist et al. | 239/312 |
| 5,950,928 | A | 9/1999 | Giang et al. | |
| 5,988,912 | A | 11/1999 | Chen | |
| 6,116,798 | A | 9/2000 | Chen et al. | |
| 6,345,773 | B1 * | 2/2002 | Shanklin et al. | 239/318 |
| 6,378,785 | B1 * | 4/2002 | Dodd | 239/318 |
| 6,425,534 | B1 * | 7/2002 | Ketcham et al. | 239/316 |
| 6,467,657 | B1 | 10/2002 | Shanklin et al. | |
| 6,562,142 | B1 | 5/2003 | Barger et al. | |
| 6,578,776 | B1 | 6/2003 | Shanklin et al. | |
| 6,604,546 | B1 | 8/2003 | Gilmore | |
| 6,672,520 | B1 | 1/2004 | Shanklin et al. | |
| 6,726,123 | B1 * | 4/2004 | Wang | 239/310 |
| 6,732,957 | B1 | 5/2004 | Kanaya et al. | |
| 6,846,512 | B1 | 1/2005 | Rohrbaugh et al. | |
| 6,869,028 | B1 | 3/2005 | Bartsch et al. | |
| 2002/0046969 | A1 * | 4/2002 | Bartsch et al. | 210/435 |
| 2002/0108640 | A1 | 8/2002 | Barger et al. | |
| 2002/0160224 | A1 | 10/2002 | Barger et al. | |
| 2003/0017960 | A1 | 1/2003 | Bertrem et al. | |
| 2003/0034051 | A1 | 2/2003 | Barger et al. | |
| 2004/0135011 | A1 | 7/2004 | Shanklin et al. | |
| 2004/0140372 | A1 | 7/2004 | Englhard et al. | |
| 2004/0221881 | A1 | 11/2004 | Wooton et al. | |
| 2005/0103699 | A1 | 5/2005 | Wooton et al. | |
| 2005/0103897 | A1 | 5/2005 | Cannon et al. | |

OTHER PUBLICATIONS

Undated web site excerpt entitled "Outdoor Window And Surface Cleaner" by S.C. Johnson & Son, Inc., admitted prior art.

* cited by examiner

FIG. 13
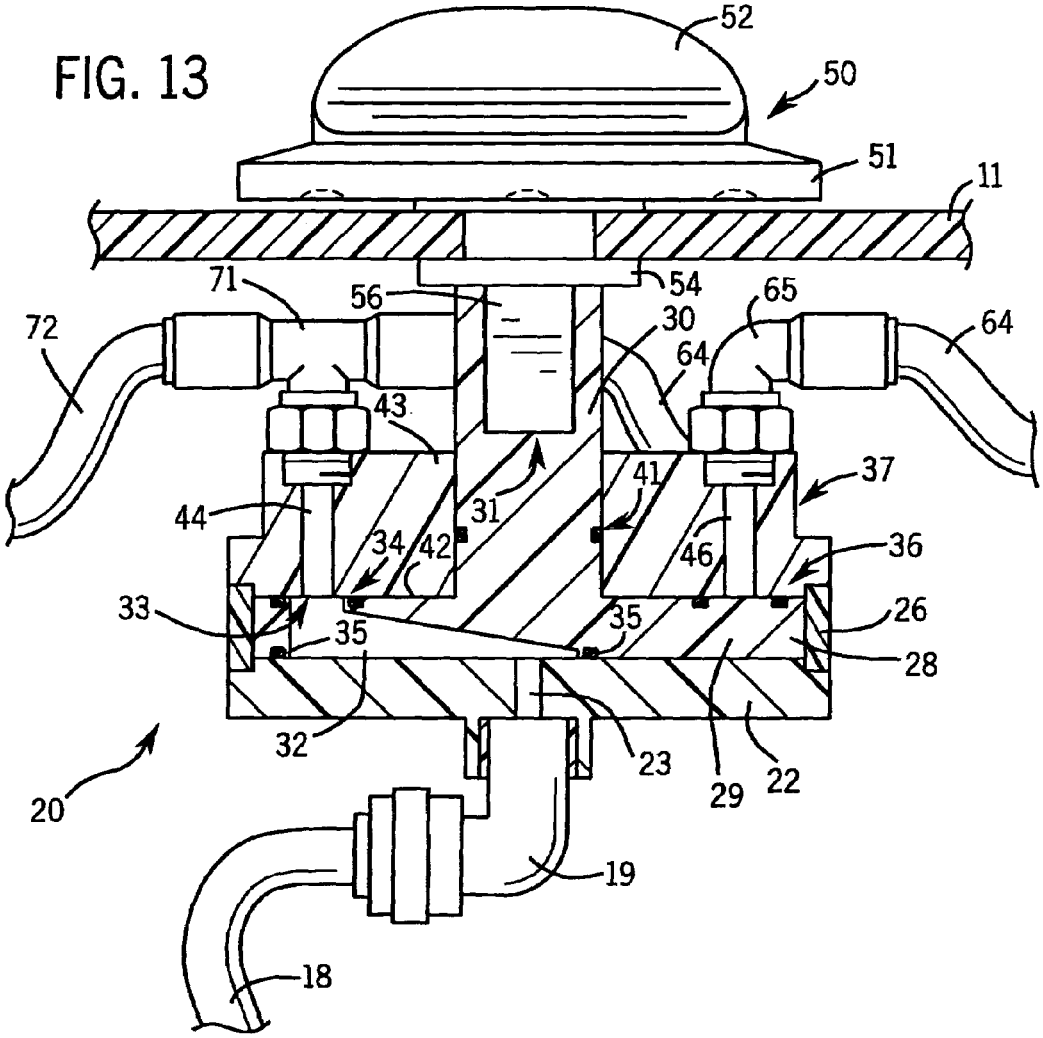
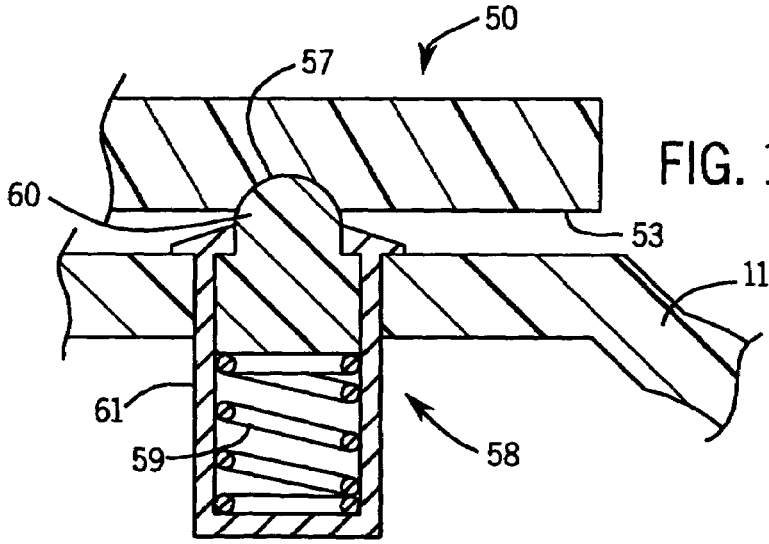
FIG. 14

SPRAYER FOR CLEANING EXTERIOR SURFACES

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

Cleaning outdoor windows can be time consuming and labor intensive. One approach tried by the art to address these concerns was described in WO 97/48927. A sprayer depicted therein was connectible to a garden hose and also included a control valve for selective spraying of a cleaning composition or rinse water. With the control valve in a "clean" position, hose water mixed with a cleaning composition inside the sprayer to allow cleaning of windows without scrubbing.

The cleaning solution was allowed to remain on the window for a suitable time period to permit the surfactant to work. Next, with the valve in a "rinse" position, hose rinse water was filtered by an ion exchange resin to remove most of the hardness and/or other residues that cause spotting and/or filming, and after rinsing the window with that filtered water the glass could dry to a cleaner finish without the need for using a squeegee.

While this improved initial spotting performance, such windows sometimes were more prone to be spotted by rain water thereafter. As a result, in U.S. Pat. No. 6,562,142 it was disclosed to use a hose end spray device to (i) apply a cleaning solution to a surface such that the solution renders the surface hydrophilic, (ii) rinse the surface to remove at least some of the cleaning solution, and (iii) then rinse the surface with purified rinse water. This reduced initial spotting and also inhibited rain water spotting, according to the patent.

However, spray devices like those of WO 97/48927 and U.S. Pat. No. 6,562,142 still had drawbacks. For example, the device of U.S. Pat. No. 6,562,142 used multiple user-manipulated control valve flow selectors that could confuse the user as to the proper sequence of surface cleaning steps. Also, both of these devices required a user to separately replace/maintain/refill a reservoir for the cleaning composition and the water filter. This entailed extra steps in preparing and maintaining the devices for use, and some problems in operation.

Therefore, a need still exists for a sprayer of this general type that can apply a cleaning solution, rinse water and also filtered water to a surface such that the surface dries with reduced spotting, where the sprayer is easier to maintain and more intuitive to operate.

SUMMARY OF THE INVENTION

The invention addresses the foregoing needs by providing a sprayer for cleaning a surface. In a first form the invention provides a sprayer having a carrier fluid supply channel, a control valve in fluid communication with the carrier fluid supply channel, and a mixing channel in fluid communication with the control valve. There is also a housing suitable to contain a chemical to facilitate cleaning of the surface, the housing being in fluid communication with the mixing channel such that a flow of carrier fluid through the mixing channel can mix the chemical into the carrier fluid if carrier fluid passes through the mixing channel and the chemical is in the housing.

The sprayer further has a rinse fluid channel in fluid communication with the control valve and a filtered fluid channel in fluid communication with the control valve. The control valve has a flow selector that is configured such that, if the carrier fluid supply channel is linked to a carrier fluid supply, rotation of the selector in a single direction (for example clockwise or counterclockwise) can selectively supply the carrier fluid to the mixing channel, or to the rinse fluid channel, or to the filtered fluid channel, or to none of the mixing channel, rinse fluid channel, and filtered fluid channel.

In a preferred form the flow selector is configured such that if the carrier fluid supply channel is linked to a carrier fluid supply rotation of the selector in a single direction can selectively and sequentially supply the carrier fluid to the mixing channel, then to the rinse fluid channel, then to the filtered fluid channel, and then to none of the mixing channel, rinse fluid channel, and filtered fluid channel. A particularly desirable variant of this is where the flow selector is configured such that if the carrier fluid supply channel is linked to a carrier fluid supply rotation of the selector in a single direction can selectively and sequentially supply the carrier fluid to none of the mixing channel, rinse fluid channel and filtered fluid channel in a first position, then to the rinse fluid channel in a second position, then to the mixing channel in a third position, then to none of the mixing channel, rinse fluid channel and filtered fluid channel in a fourth position, then to the rinse fluid channel in a fifth position, and then to the filtered fluid channel in a sixth position. In this latter variant it is desirable, for reasons of making the selector highly intuitive, for the first and fourth positions to be essentially 180 degrees rotationally apart from each other, and the second and fifth positions to be essentially 180 degrees rotationally apart from each other.

In another desirable form the flow selector is located on an upper surface of the sprayer, the mixing channel, the rinse fluid channel and the filtered fluid channel are all in fluid communication with an outlet nozzle, and the outlet nozzle includes means for adjusting a spray pattern for at least one of the mixing channel, the rinse fluid channel and the filtered fluid channel. The means for adjusting the spray pattern includes at least one pair of orifices in the nozzle wherein one of the pair of orifices has an inner wall of greater diameter at a front wall of the nozzle compared to a back wall of the nozzle.

In other preferred forms the mixing channel, the rinse fluid channel and the filtered fluid channel are in fluid communication with a nozzle, and the mixing channel, the rinse fluid channel, the filtered fluid channel, and the nozzle are dimensioned such that a fluid stream from the nozzle can reach at least three meters, and preferably at least five meters, from the nozzle. To facilitate this the control valve can include a first plate having an inlet hole in fluid communication with the carrier fluid supply channel, and a second plate having a first flow hole in fluid communication with the rinse fluid channel, a second flow hole in fluid communication with the mixing channel, a third flow hole in fluid communication with the rinse fluid channel, and a fourth flow hole in fluid communication with the filtered fluid channel.

In this form, when the control valve is in the second position, the inlet hole and the first flow hole are in aligned relationship; when the control valve is in the third position, the inlet hole and the second flow hole are in aligned relationship; when the control valve is in the fifth position, the inlet hole and the third flow hole are in aligned relationship; and when the control valve is in the sixth position, the inlet hole and the fourth flow hole are in aligned relationship.

To implement the use of the filtered fluid channel, a filter can be disposed in the filtered fluid channel, and the housing (in the form of a reservoir) and the filter can be housed in a cartridge that is removable as a unit from the control valve. Also, a chemical supply channel can provide a flow path between the mixing channel and the reservoir. In such a form the surface treating chemical, for example, a concentrated solution of cleaner (e.g., one or more surfactants) and surface modifier (e.g., one or more polymers) is positioned in the reservoir, the filter includes deionizing media whose deionizing performance diminishes over a period of time of use of the sprayer, and the chemical supply channel is dimensioned such that the reservoir becomes depleted of the chemical when the deionizing performance drops below a predetermined level.

In yet another preferred form a chemical supply channel provides a flow path between the mixing channel and the reservoir, the chemical is positioned in the reservoir, a carrier fluid intake channel is positioned between the filter and the reservoir, the carrier fluid intake being located in a flow path of the filtered fluid channel upstream of the filter, the reservoir has an outlet coupling for placing the reservoir in fluid communication with the chemical supply channel, the filter has an outlet coupling for placing the filter in fluid communication with the filtered fluid channel the carrier fluid intake channel has an inlet coupling for placing the carrier fluid intake channel in fluid communication with the filtered fluid channel, and the reservoir outlet coupling, the filter outlet coupling, and the inlet coupling all open in a common direction.

In still other preferred forms the reservoir and the filter may be removed and replaced with a refill cartridge comprising an unitary reservoir and filter by way of an opening in a bottom wall of the sprayer, the opening, an end of the reservoir, and an end of the filter are covered by a door, the door has a lower surface structured for supporting the sprayer in a standing position.

In another aspect the invention provides a refill for such a sprayer, where the refill has a filter, and a reservoir containing a surface treating chemical. The filter and the reservoir are housed in a unitary cartridge.

In one preferred form the filter and the reservoir are cylindrical, and the refill is suitable for use in a sprayer of the type having a carrier fluid supply channel, a filtered fluid channel in fluid communication with the carrier fluid supply channel, and a mixing channel in fluid communication with the carrier fluid supply channel. This refill also has a carrier fluid intake channel positioned between the filter and the reservoir.

In another preferred form the reservoir has an outlet coupling, the filter has an outlet coupling, the carrier fluid intake channel has an inlet coupling, and the reservoir outlet coupling, the filter outlet coupling, and the inlet coupling are located adjacent one end of the refill. Most preferably the reservoir outlet coupling, the filter outlet coupling, and the inlet coupling are all positioned in a linear relationship with respect to each other.

It will be appreciated that the present invention thereby provides a sprayer particularly well suited to clean the outsides of building windows, building siding, patio furniture, kids toys, etc., where the sprayer is highly intuitive in its operation and easy for a consumer to maintain. The sprayer is also relatively lightweight and is inexpensive to produce.

The foregoing and other advantages of the invention will become apparent from the following description. In that description reference is made to the accompanying drawings which form a part thereof, and in which there is shown by way of illustration preferred embodiments of the invention. However, it should be understood that these embodiments do not represent the full scope of the invention. Reference should therefore be made to the claims herein for interpreting the scope of the invention.

BRIEF DESCRIPTION OF THE DRAWINGS

FIG. 13 is a partial cross-sectional view taken generally along line 13—13 of FIG. 1;

FIG. 14 is a partial cross-sectional view taken along line 14—14 of FIG. 1;

DETAILED DESCRIPTION OF THE INVENTION

Figure 1:
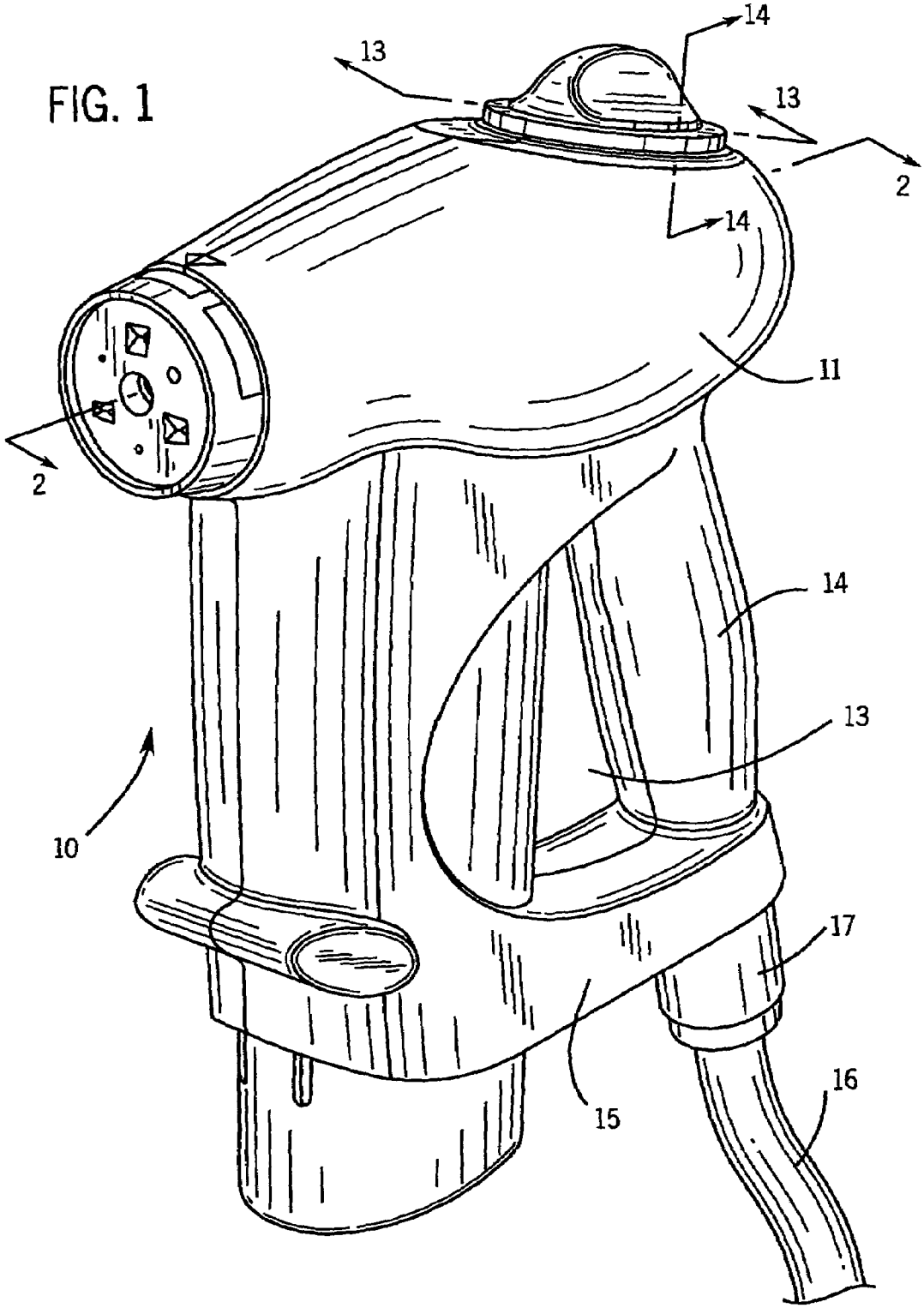
FIG. 1 is a perspective view of a sprayer of the present invention shown as linked to a garden hose.
Figure 2:
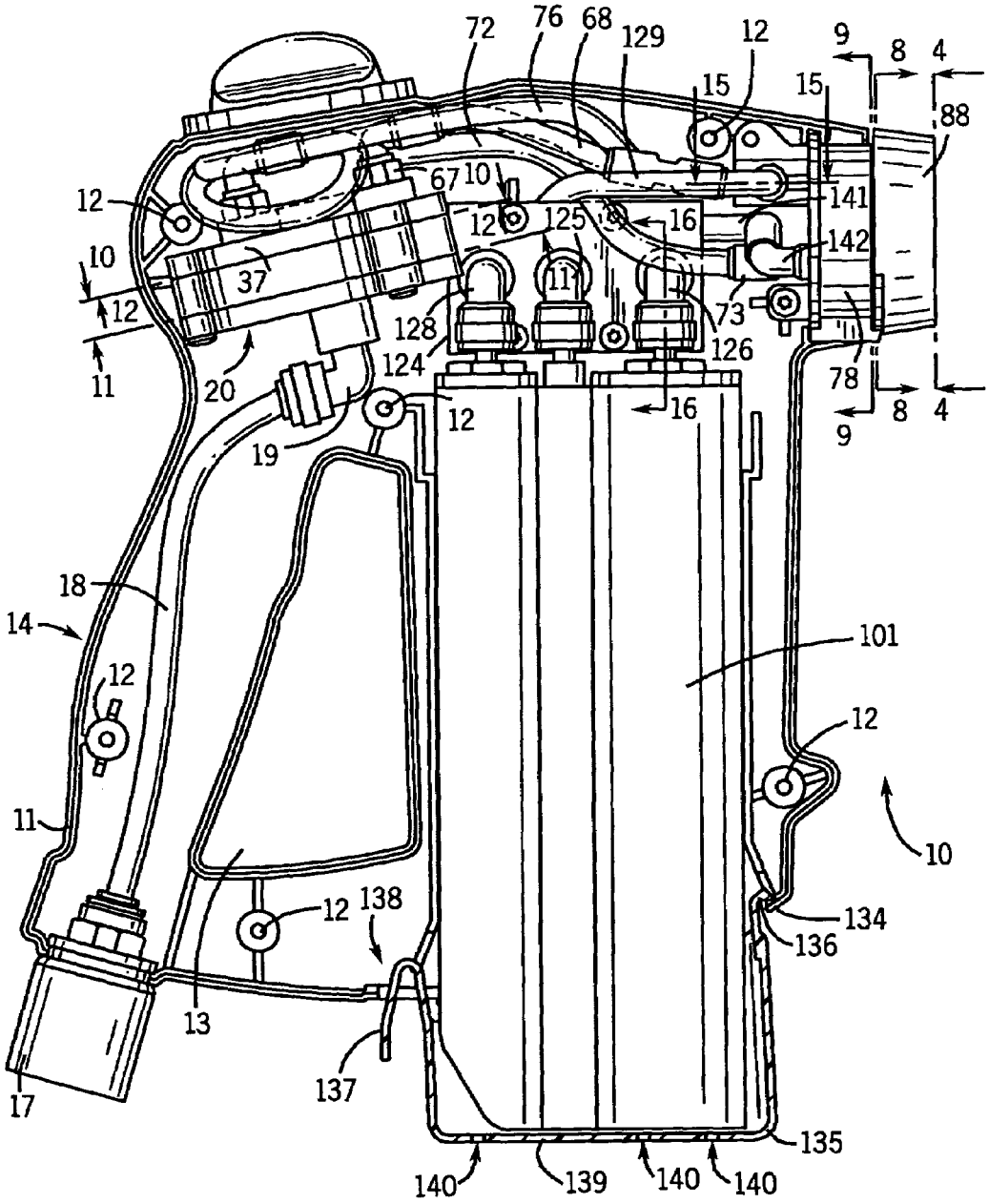
FIG. 2 is a cross-sectional view thereof taken along line 2—2 of FIG. 1.

Looking first at FIGS. 1 and 2, there is shown a sprayer 10 having an outer housing 11 with a hole 13 that facilitates a grip 14 for the hand of a user. The housing 11 includes two clamshell parts that mate and are held together by screws that engage screw holes 12 on the interior surface of one of the housing parts. The sprayer 10 may coupled to a hose 16 (typically a garden hose) using an internally threaded coupling 17 to provide a fluid to the sprayer.

While water is the preferred fluid, the sprayer will also work with other fluids as well. Further, while the product is most suitable for use in cleaning the outsides of building windows, it can be used for other surface treating purposes, regardless of whether the surface is glass or other material (e.g., hard or soft surfaces capable of withstanding water and surfactants). For example, it could be used to clean billboards even though the outside surface of the billboard is not glass.

The coupling 17 is in fluid communication with a carrier fluid supply channel 18 that is connected to a carrier fluid coupling 19 that provides water to a control valve 20. A connector web 15 between the bottom of the grip 14 and the remainder of the housing 11 adds stability to the sprayer 10, especially because the bottom end of the grip 14 is attached to the hose 16 which may need to be dragged by a user.

Referring particularly to FIGS. 10–14 and 17, the control valve 20 serves to distribute water to various fluid conduits in the sprayer 10. The control valve 20 includes a fixed lower plate 22 including central hole 23 that is placed in fluid communication with the carrier fluid coupling 19. The lower plate 22 has mounting holes 24 that receive screws 25 that are used to assemble the control valve 20. A mounting ring 26 with mounting holes 27 is assembled above the lower plate 22.

With particular reference to FIGS. 10, 11, 13 and 17, a rotatable flow diverter 28 including a lower portion circular disc 29 and a central shaft 30 normal to the disc 29 is assembled inside the mounting ring 26. The shaft 30 has a square upper inner recess 31. The flow diverter 28 has a generally oblong flow channel 32 in its lower surface (see FIG. 11) that provides a fluid path from the central hole 23 of the lower plate 22 to a flow hole 33 that extends through the top surface of the flow diverter 28 (see FIG. 10). A sealing O-ring 34 is provided around the top of flow hole 33 (see FIG. 10) and a sealing ring 35 is provided around the oblong flow channel 32. Another sealing O-ring 36 is provided in the top surface of the flow diverter 28 at 180 degrees from the flow hole 33.

Figure 12:
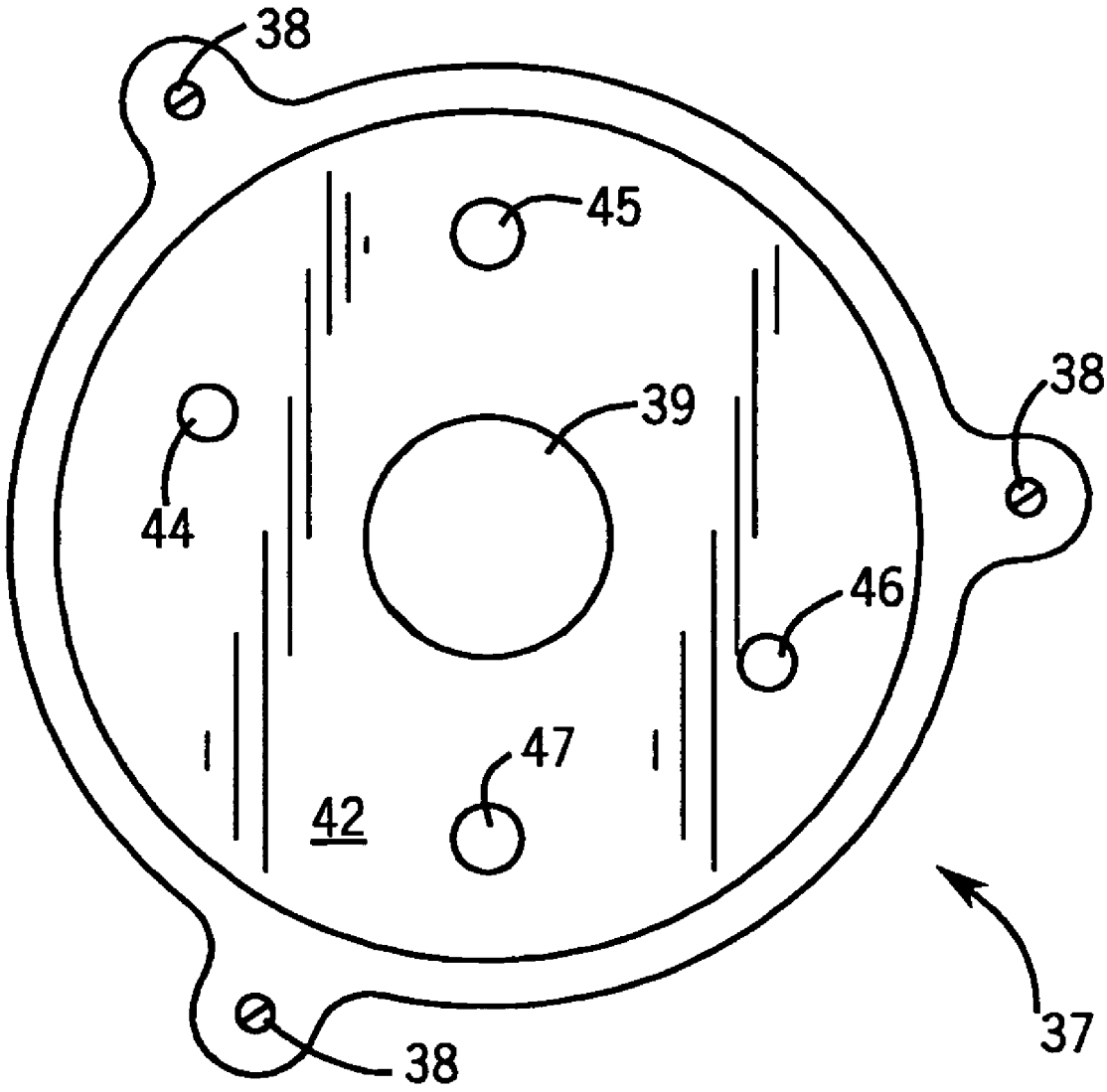
FIG. 12 is a view taken along line 12—12 of FIG. 2.

Looking at FIGS. 12 and 13, a fixed top plate 37 with mounting holes 38 is assembled on top of the disc 29 of the flow diverter 28. A central hole 39 in the top plate 37 fits over the shaft 30 of the flow diverter 28 such that the flow diverter 28 may rotate within the central hole 39 of the top plate 37. An O-ring 41 provides a seal between the central hole 39 in the top plate 37 and the shaft 30. The top plate 37 has a lower surface 42 and an upper surface 43.

Looking at FIG. 12, four flow holes extend from the lower surface 42 through to the upper surface 43 of the top plate 37. There is a first flow hole 44, a second flow hole 45, a third flow hole 46 and a fourth flow hole 47.

Figure 17:
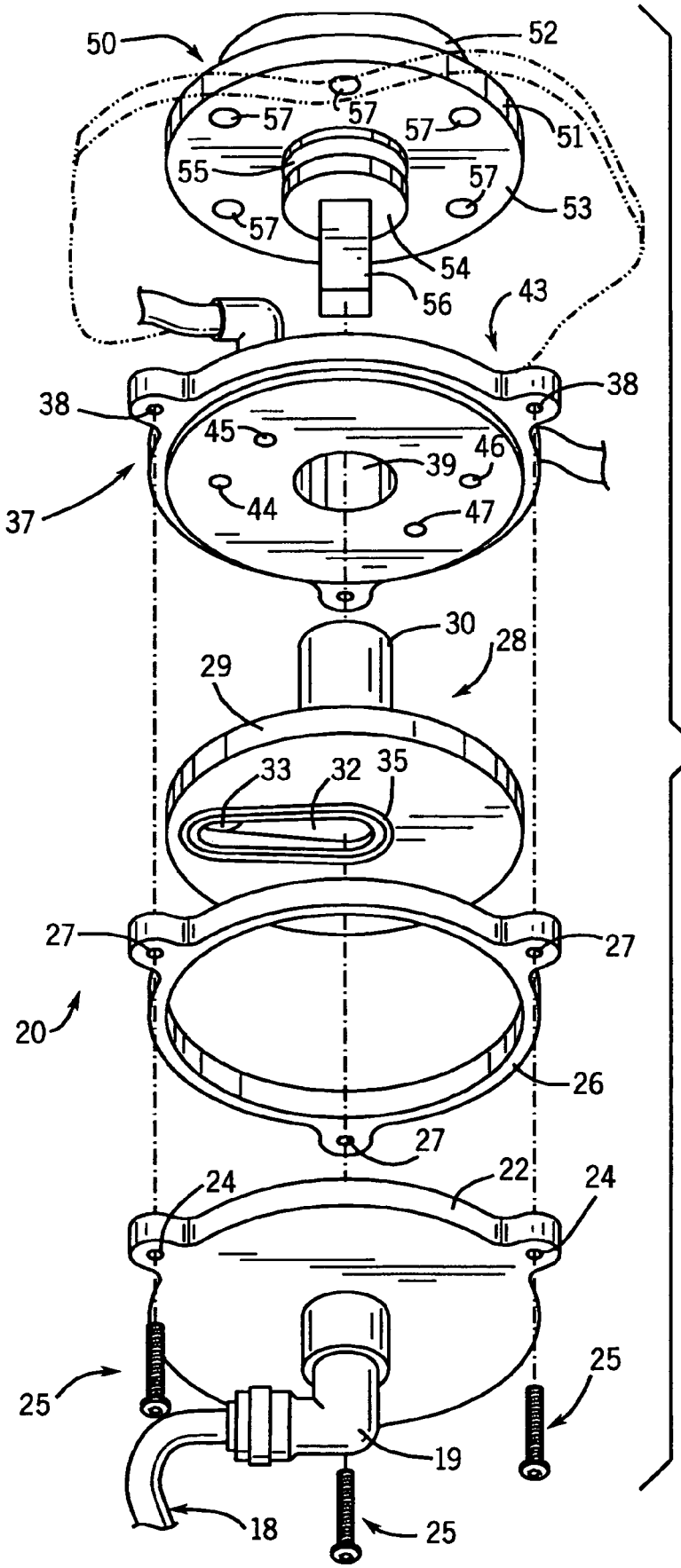
FIG. 17 is a lower exploded perspective view of a control valve of the sprayer of FIG. 1.

Turning now to FIGS. 13, 14 and 17, there is shown a flow selector 50 of the sprayer 10.

The flow selector 50 has a generally disc shaped lower section 51 and an upwardly extending finger grip 52. Clockwise or counterclockwise rotation of the flow selector 50 may be used, with a consistent clockwise rotation being preferred throughout the cleaning operation. A projection 54 extends downwardly from a lower surface 53 of the flow selector 50. The projection 54 has a circumferential inwardly directed channel 55 that receives a wall of the housing 11 for rotatable movement of the flow selector 50 with respect to the housing 11 of the sprayer 10. A square shaft 56 extends downwardly from the projection 54. The square shaft 56 of the flow selector 50 is received in the square inner recess 31 of the shaft 30 of the flow diverter 28. Thus, the flow selector 50 may be turned by a user to rotate the flow diverter 28.

The flow selector 50 has six positions for controlling fluid flow in the sprayer 10. Looking at FIGS. 14 and 17, means for holding the flow selector 50 in each of the six positions is shown. A biasing insert 58 is provided in the top wall of the sprayer housing 11. The biasing insert 58 has a pocket 61 holding a coil spring 59 that biases a button 60 upward. The lower surface 53 of the flow selector 50 has six indentations 57 that cooperate with the button 60 to hold the flow selector in one of six positions until a user rotates the flow selector 50 to a next position. An example position sequence is as follows: (1) spray Off; (2) rinse 1; (3) soap; (4) spray off; (5) rinse 2; and (6) filtered rinse. The fluid flow paths in each of these positions will be described below.

Referring now to FIGS. 2 and 13, fluid flowing through each of the first flow hole 44, the second flow hole 45, the third flow hole 46 and the fourth flow hole 47 of the top plate 37 of the control valve 20 proceeds toward a nozzle 88 of the sprayer 10, albeit via varied paths. A coupling 65 is assembled on the top plate 37 to provide a fluid path from the third flow hole 46 of the control valve 20 to a conduit 64. The conduit 64 is coupled to a tee coupling 71 that is assembled on the top plate 37 above the first flow hole 44 of the control valve 20. A conduit 72 provides a fluid flow path from the tee coupling 71 to a coupling 73 on a nozzle mounting cap 78 (see FIG. 2).

Figure 15:
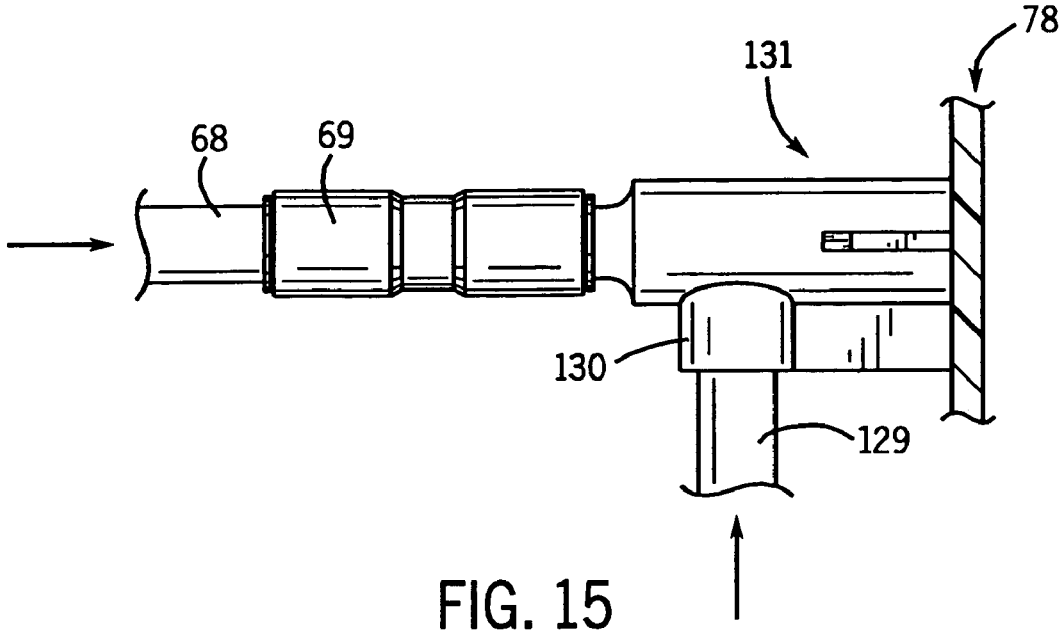
FIG. 15 is a partial cross-sectional view taken along line 15—15 of FIG. 2.

Looking at FIGS. 2 and 15, a coupling 67 is assembled on the top plate 37 of the control valve 20 to provide a fluid path from the second flow hole 45 of the control valve 20 to a conduit 68 which is connected to a coupling 69 on an aspirator 131 (described further below).

Looking at FIG. 2, a coupling is assembled on the top plate 37 of the control valve 20 to provide a fluid path from the fourth flow hole 47 of the control valve 20 to a conduit 76 which is connected to a fluid intake coupler 125 (described further below).

Turning now to FIGS. 2, 3, 16 and 19, the sprayer 10 includes a cartridge 101 that provides a refillable means for providing a chemical, such as soap, to fluid received from the control valve 20 and for filtering fluid received from the control valve 20. Looking at FIG. 19, the cartridge 101 has an outer wall 102 that forms the cartridge 101 with a cylindrical fluid intake channel 105 positioned between a cylindrical filter 108 and a generally cylindrical chemical housing 120 that contains a chemical such as soap in an example amount of 1 to 4 fluid ounces.

One example soap is a detergent sold under the designation DV7382 by Rhodia. The soap chemistry preferably leaves cleaned surfaces with a hydrophilic character that will sheet water, thus preventing water drops from forming as the surface dries after rinsing.

Figure 19:
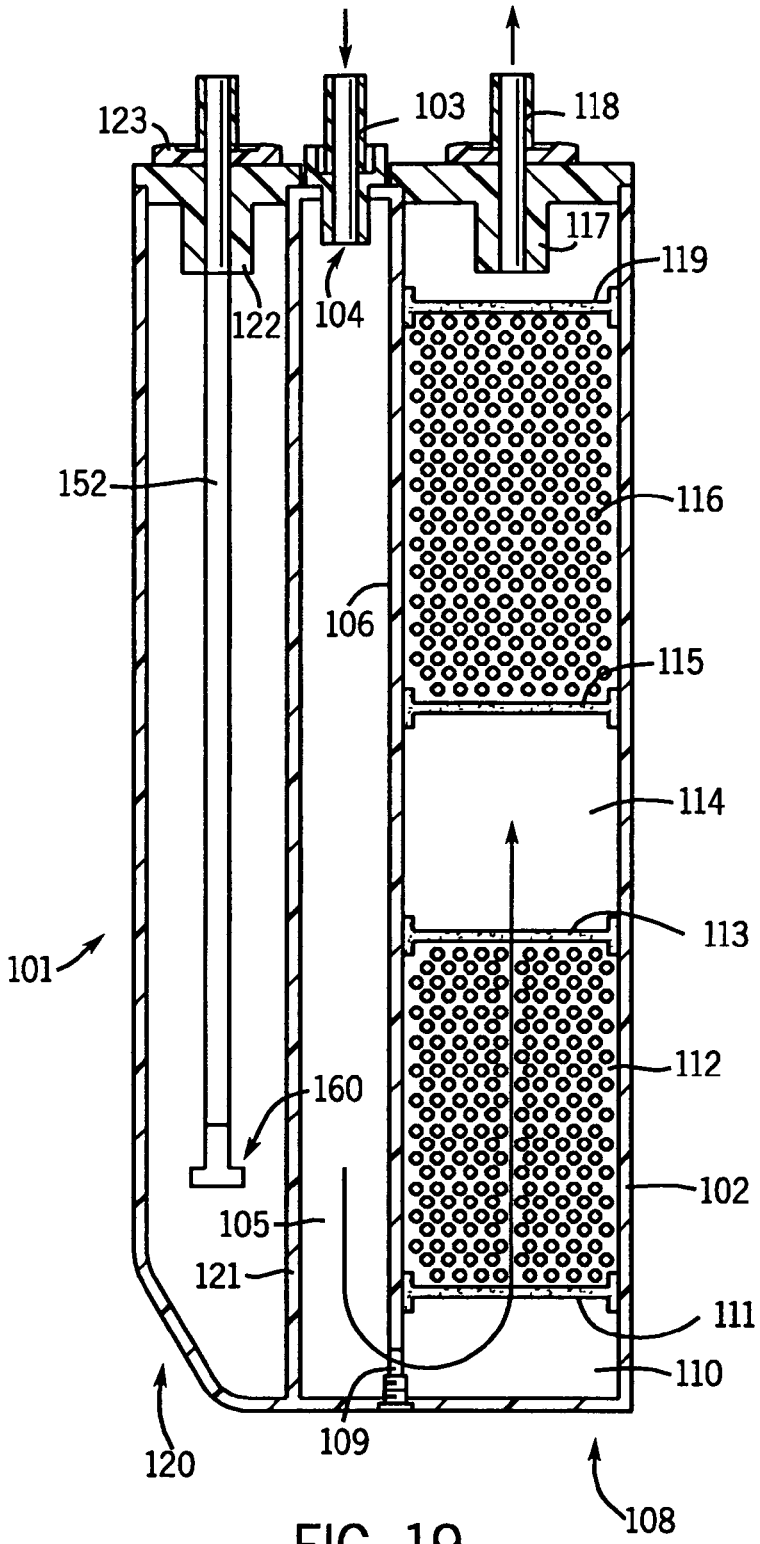
FIG. 19 is a vertical cross sectional view of a refill cartridge that is installable in the sprayer as shown in FIG. 2.
Figure 19A:
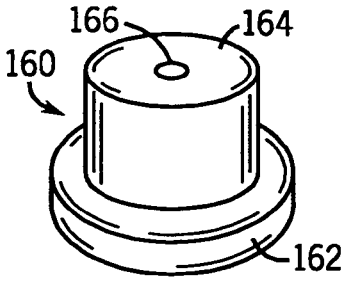
FIG. 19A is a perspective view of a chemical flow restrictor used in the refill cartridge of FIG. 19.

A first wall 106 connects the fluid intake channel 105 and the filter 108, and a second wall 121 connects the fluid intake channel 105 and the chemical housing 120. A fluid inlet coupling 103 provides a flow path to a fluid inlet 104 of the fluid intake channel 105. A fluid intake passage 109 provides a flow path from the fluid intake channel 105 to the filter 108. A coupling 123 provides a flow path to an outlet 122 of the chemical housing 120. The outlet 122 of the chemical housing 120 is connected to a hollow tubular pick-up tube 152 having a flow restrictor 160 at the lower end of the pick-up tube 152. Looking at FIG. 19A, the flow restrictor 160 has a lower disk shaped section 162 and an upper cylindrical section 164. A through hole 166 extends through the lower disk shaped section 162 and the upper cylindrical section 164 of the flow restrictor 160 to provide a flow path from the chemical housing 120 to the pick-up tube 152. The flow restrictor 160 limits the amount of chemical entering the pick-up tube 152. In one form, the through hole 166 of the pick-up tube 152 has a 0.0001 inch inside diameter.

The filter 108 includes a fluid intake section 110, and a first separator 111 positioned between the fluid intake section 110 and a first deionizing media section 112. A second separator 113 is positioned between the first deionizing media section 112 and a flow space 114. A third separator 115 is positioned between the flow space 114 and a second deionizing media section 116. A fourth separator 119 is positioned between the second deionizing media section 116 and a filter outlet 117 in fluid communication with a filter outlet coupling 118. The fourth separator 119 prevents deionizing media from entering the filter outlet 117 by containing the media downstream of the filter outlet 117. The separators 111, 113, 115, 119 may be, for example, nylon, polyester, or polypropylene screens.

The first deionizing media section 112 preferably includes strong acid cation ion exchange resin beads which serve to remove cations such as cations of magnesium, calcium, lead, mercury, sodium, and cesium from the carrier fluid.

The second deionizing media section 116 preferably includes strong base anion ion exchange resin beads which serve to remove anions such as nitrates, nitrites, sulfates, silicates, carbonates, and chlorides from the carrier fluid. Suitable strong acid cationic and strong base anionic ion exchange resin beads are available under the trademark Dowex® from The Dow Chemical Company, Midland, Mich., USA. Weak acid cationic and weak base anionic exchange resins may also be suitable for certain applications, and mixed bed resins, such as a strong acid cationic and a strong base anionic, may also be suitable. These are also available from The Dow Chemical Company.

Sequential beds of strong base anionic beads followed by weak acid cationic beads can be beneficial because the ion exchange capacity of weak acid cationic is two times as strong as strong acid. In this configuration, the metal must be in an alkaline state. The ratio of the beads can vary, for example, a 60/40 blend or a 50/50 ratio of beads in separate/sequential beds.

An example deionizing filter uses strong acid cationic (40% by wt.) and strong base anionic (60% by wt.) with beads of less than 400 microns. When the fluid entering the fluid intake section 110 of the filter 108 is water, cations are removed in the first deionizing media section 112 such that only hydrogen ions are present in the flow space 114, and anions are removed in the second deionizing media section 116 leaving only hydroxide anions in the water. As a result, deionized water exits the filter outlet 117. Because minerals are removed from the water, spotting on the surface that has been cleaned is minimized or eliminated when the surface is rinsed with the deionized water.

Figure 3:
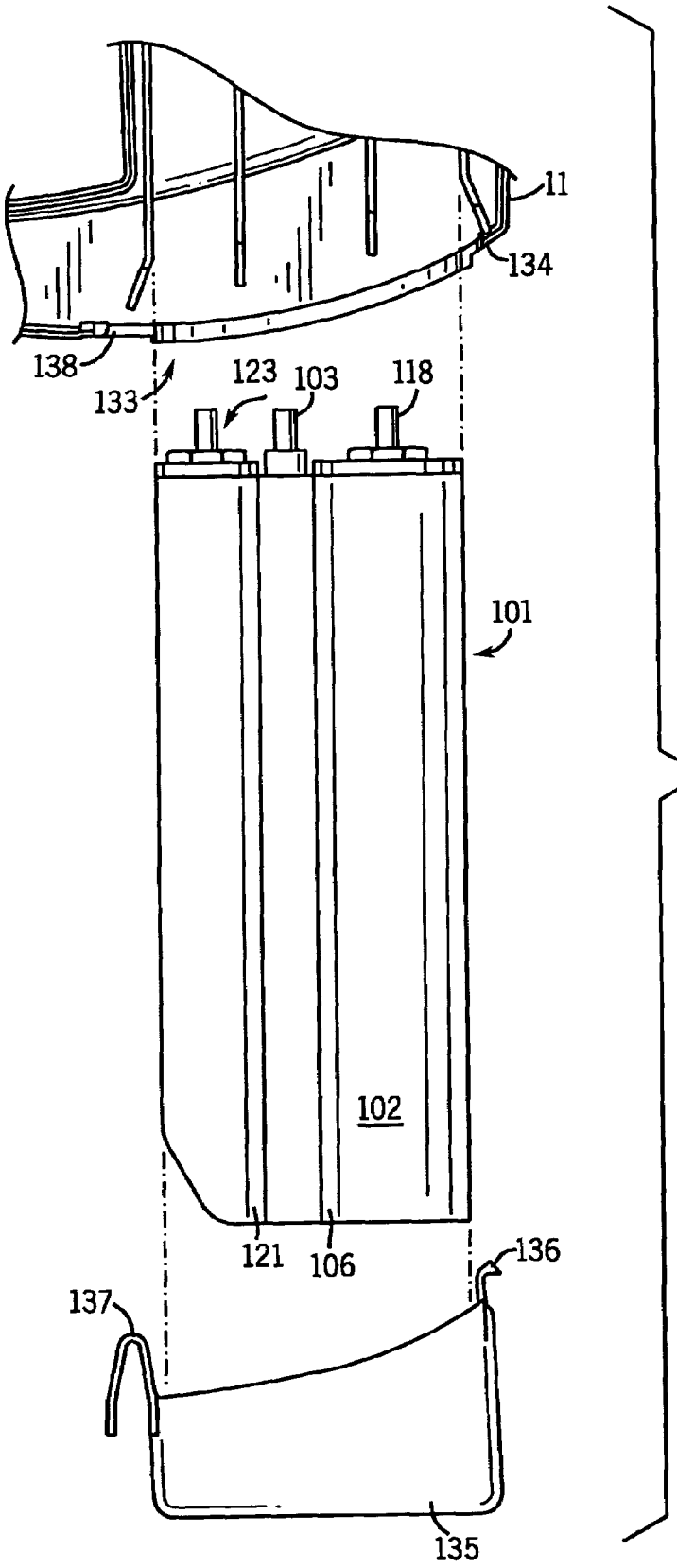
FIG. 3 is a somewhat exploded view of the lower right portion of the FIG. 2 drawing.
Figure 16:
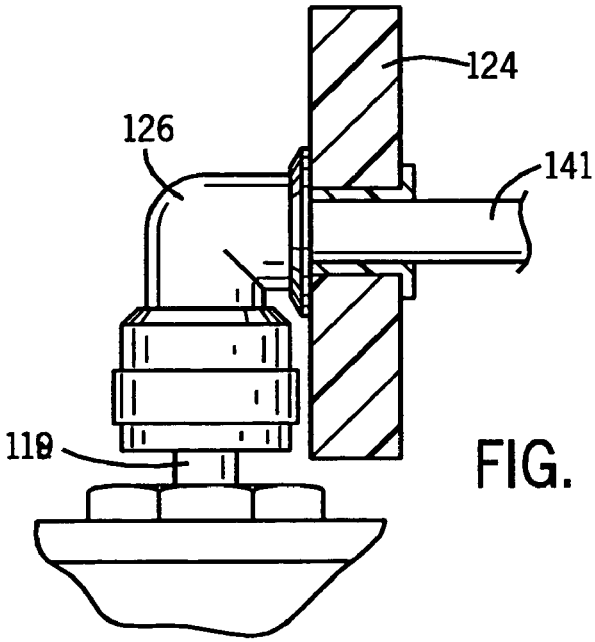
FIG. 16 is a partial cross-sectional view taken along line 16—16 of FIG. 2.

Referring to FIGS. 2, 3 and 16, the installation of the cartridge 101 in the sprayer 10 is shown. The sprayer 10 includes an opening 133 in the bottom of the housing 11. The opening 133 is sized to receive the cartridge 101 and a flange 134 is provided adjacent to opening 133. The cartridge 101 is inserted upward into the opening 133. The sprayer 10 has a door 135 for keeping the cartridge 101 in the sprayer 10. A flange 136 on the door 135 engages the flange 134 of the housing 11 to provide a hinge location for the door 135. A catch 137 on the door 135 engages an opening 138 in the housing 11 to keep the door 135 closed and the cartridge 101 in the sprayer 10. Preferably, the door 135 has a flat lower surface 139 structured for supporting the sprayer 10 in an upright standing position. Optionally, the flat lower surface 139 has drainage holes 140.

Still referring to FIGS. 2, 3 and 16, the sprayer 10 includes a mounting plate 124 that supports a fluid intake coupler 125, a filter coupler 126 and a chemical housing coupler 128. When the cartridge 101 is inserted upward into the opening 133, the fluid inlet coupling 103 sealingly engages the fluid intake coupler 125, the filter outlet coupling 118 sealingly engages the filter coupler 126, and coupling 123 sealingly engages the chemical housing coupler 128. The fluid inlet coupling 103, the filter outlet coupling 118, and the coupling 123 are typically covered with a protective seal when purchased by the consumer. The seal is removed before installation of the cartridge 101. The fluid inlet coupling 103, the filter outlet coupling 118, and the coupling 123 are also positioned in a linear relationship for ease of installation.

Referring now to FIGS. 2 and 16, a flow path is provided from the filter coupler 126 to a coupling 142 on the nozzle mounting cap 78 by conduit 141. Also, looking at FIGS. 2 and 15, a flow path is provided from the chemical housing coupler 128 to a coupling 130 on the aspirator 131 by a conduit 129 which serves as part of a chemical supply channel into the aspirator 131, which functions in a conventional manner. The carrier fluid, typically water, enters the aspirator 131 by way of coupling 69. As the carrier fluid flows through a mixing chamber of the aspirator 131, the flow of carrier creates a pressure drop (venturi effect), which draws chemical (e.g. soap concentrate) through the conduit 129 from the chemical housing 120 into the mixing chamber, where the chemical mixes with the stream of carrier fluid to produce a chemical/carrier fluid solution.

The sprayer 10 may include various means for avoiding the need for a use up cue for the filter 108. It is well known that the deionizing performance of a bed of ion exchange resin beads diminishes over a period of time of use. In the sprayer 10, various configurations can be employed such that the deionizing performance of the ion exchange resin beads reaches a level that warrants replacement of the filter at approximately the same time that the chemical is depleted in the chemical housing 120. For example, the inside diameter of the conduit 129 of the chemical supply channel may be dimensioned such that the chemical housing 120 becomes depleted of the chemical when the deionizing performance of the ion exchange resin beads drops below a predetermined level. Alternatively, the amount of ion exchange resin beads present in the filter may be adjusted such that the chemical housing 120 becomes depleted of the chemical when the deionizing performance drops below a predetermined level.

Figure 9:
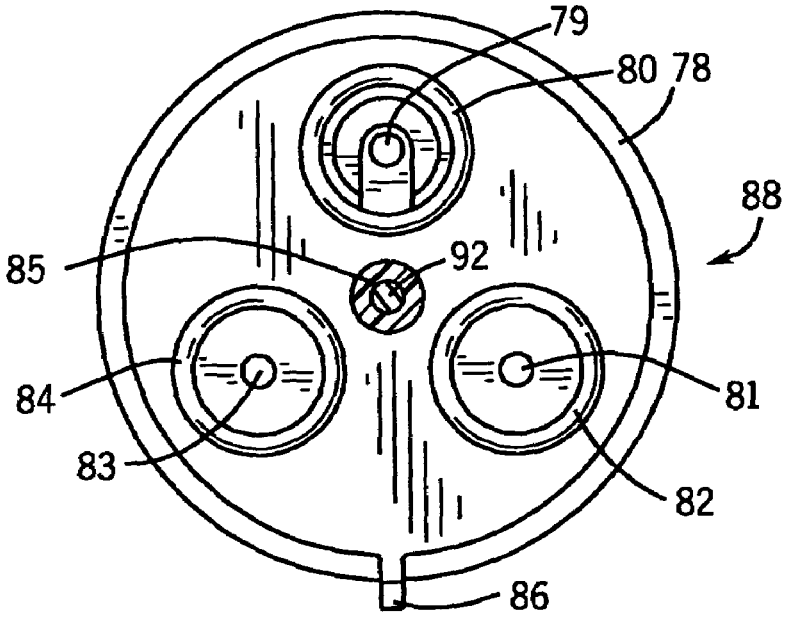
FIG. 9 is a view taken along line 9—9 of FIG. 2.
Figure 10:
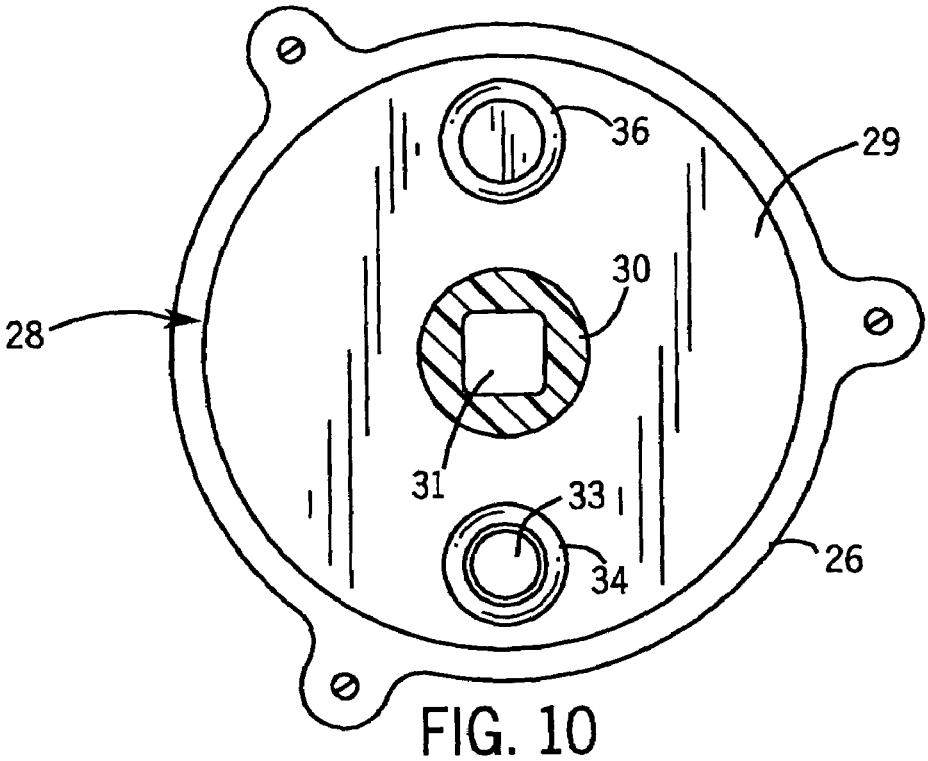
FIG. 10 is a view taken along line 10—10 of FIG. 2.
Figure 11:
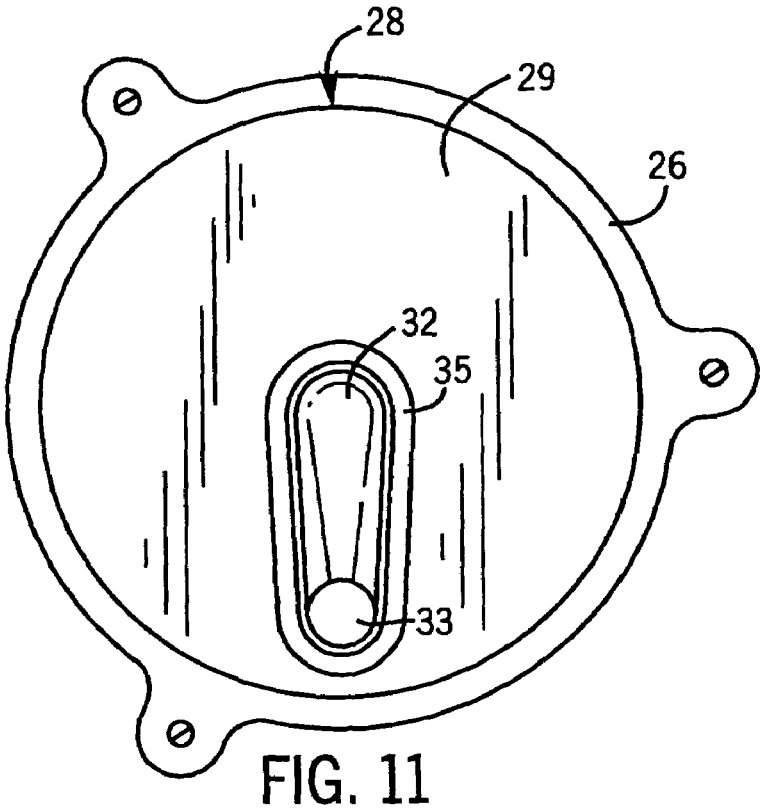
FIG. 11 is a view taken along line 11—11 of FIG. 2.

Turning to FIGS. 2 and 9, the various flow paths from the control valve 20, the cartridge 101 and the aspirator 131 arrive at the nozzle mounting cap 78. Looking at FIG. 9, the nozzle mounting cap 78 has a diluted chemical flow hole 79 surrounded by a sealing O-ring 80, a rinse fluid flow hole 81 surrounded by a sealing O-ring 82, and a filtered fluid hole 83 surrounded by a sealing O-ring 84. The diluted chemical flow hole 79 is in fluid communication with the aspirator 131, the rinse fluid flow hole 81 is in fluid communication with the coupling 73, and the filtered fluid hole 83 is in fluid communication with the coupling 142. The nozzle mounting cap 78 has a central threaded opening 85 for receiving a screw when assembling the nozzle 88 to the nozzle mounting cap 78. The nozzle mounting cap 78 also has a nozzle rotation stop 86 that limits rotation of the nozzle 88 with respect to the nozzle mounting cap 78.

Figure 4:
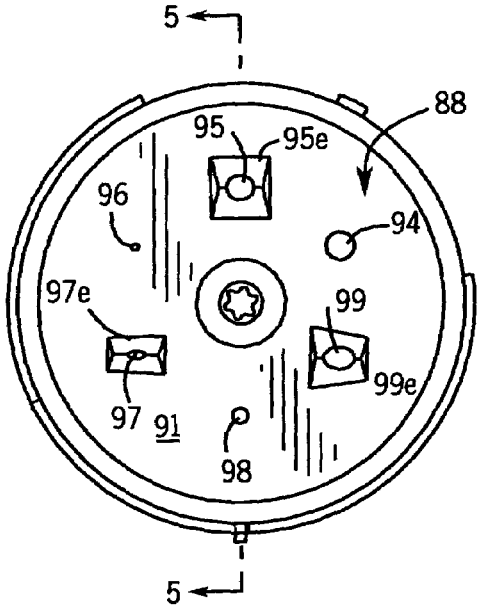
FIG. 4 is a plan view thereof taken along line 4—4 of FIG. 2.
Figure 8:
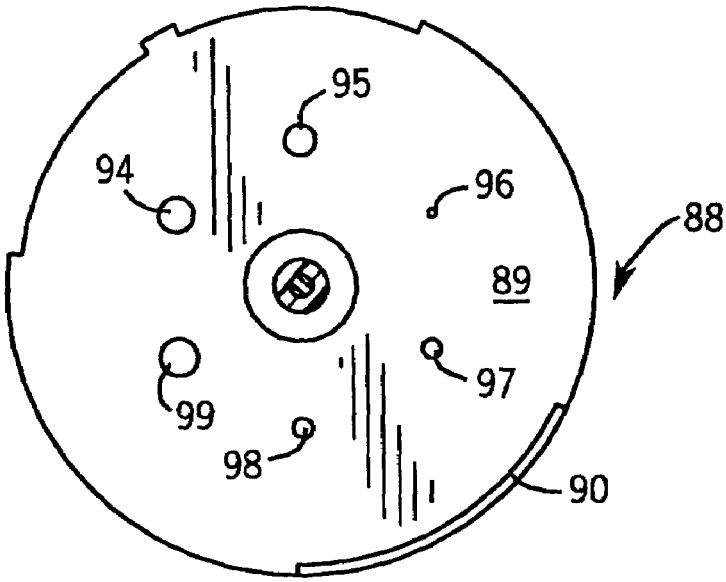
FIG. 8 is a view taken along line 8—8 of FIG. 2.

Looking now at FIGS. 4 and 8, the nozzle 88 includes six different flow paths. A first diluted chemical orifice 94 has a constant inside diameter that provides a stream of diluted chemical from the nozzle 88. A second diluted chemical orifice 95 has a constant inside diameter at the rear of the orifice and a diverging front end 95*e* that provides a fan spray of diluted chemical from the nozzle 88. A first rinse fluid orifice 96 has a constant inside diameter that provides a stream of rinse fluid from the nozzle 88. A second rinse fluid orifice 97 has a constant inside diameter at the rear of the orifice and a diverging front end 97*e* that provides a fan spray of rinse fluid from the nozzle 88.

A first filtered fluid orifice 98 has a constant inside diameter that provides a stream of filtered fluid from the nozzle 88. A second filtered fluid orifice 99 has a constant inside diameter at the rear of the orifice and a diverging front end 99*e* that provides a fan spray of filtered fluid from the nozzle 88. The nozzle 88 also has a recess 90 in rear surface 89 that engages the nozzle rotation stop 86 on the nozzle mounting cap 78 such that the nozzle rotation stop 86 can limit rotation of the nozzle 88 with respect to the nozzle mounting cap 78. The rear surface 89 of the nozzle 88 is smooth for ease of manufacture and also movement of the nozzle 88. The nozzle 88 also has a well 93 in the front surface 91 for accepting a screw 92 that assembles the nozzle 88 on the nozzle mounting cap 78. Six different flow paths are provided in the nozzle 88 to avoid cross-contamination of the soapy water, rinse water and deionized water.

Figure 5:
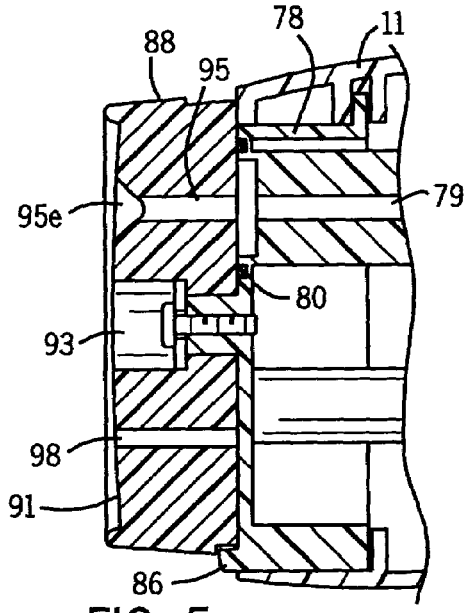
FIG. 5 is a cross-sectional view thereof taken along line 5—5 of FIG. 4.
Figure 6:
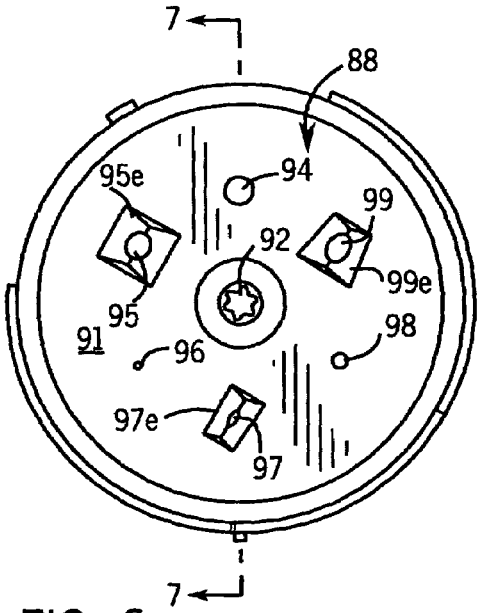
FIG. 6 is a view similar to FIG. 4, but showing the nozzle rotated with respect to the view of FIG. 4.
Figure 7:
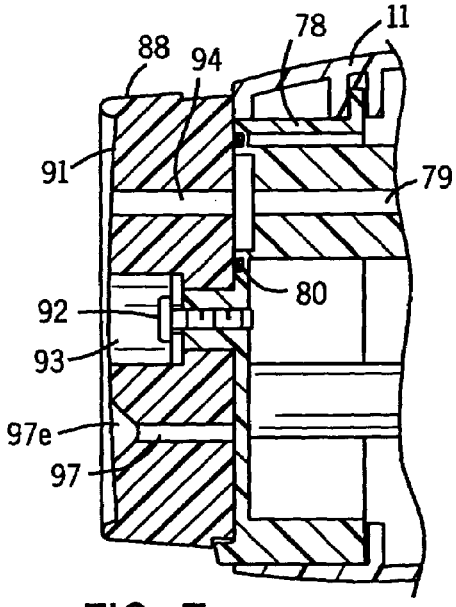
FIG. 7 is a cross-sectional view thereof taken along line 7—7 of FIG. 6.

By referring to FIGS. 5 and 7, the selection of different spray patterns by way of rotation of the nozzle 88 can be explained. In FIG. 5, the nozzle 88 is positioned such that the diluted chemical flow hole 79 of the nozzle mounting cap 78 aligns with the second diluted chemical orifice 95 of the nozzle 88. Fluid entering the second diluted chemical orifice 95 expands in the diverging front end 95*e* thereby providing a fan spray. In FIG. 7, the nozzle 88 is positioned such that the diluted chemical flow hole 79 of the nozzle mounting cap 78 aligns with the first diluted chemical orifice 94 of the nozzle 88. Fluid entering the first diluted chemical orifice 94 exits the nozzle in a stream. In a similar manner, fluid entering the first rinse fluid orifice 96 from the rinse fluid flow hole 81 provides a stream of rinse fluid from the nozzle 88. Fluid entering the second rinse fluid orifice 97 from the rinse fluid flow hole 81 provides a fan spray of rinse fluid from the nozzle 88.

Fluid entering the first filtered fluid orifice 98 from the filtered fluid hole 83 provides a stream of filtered fluid from the nozzle 88. A second filtered fluid orifice 99 has a constant inside diameter at the rear of the conduit and a diverging front end 99*e* that provides a fan spray of filtered fluid from the nozzle 88. In the case of a stream or a fan spray for any fluid, the stream or fan spray can reach building windows which are 5–20 meters (typically 5–10 meters) above the nozzle outlet.

Figure 18:
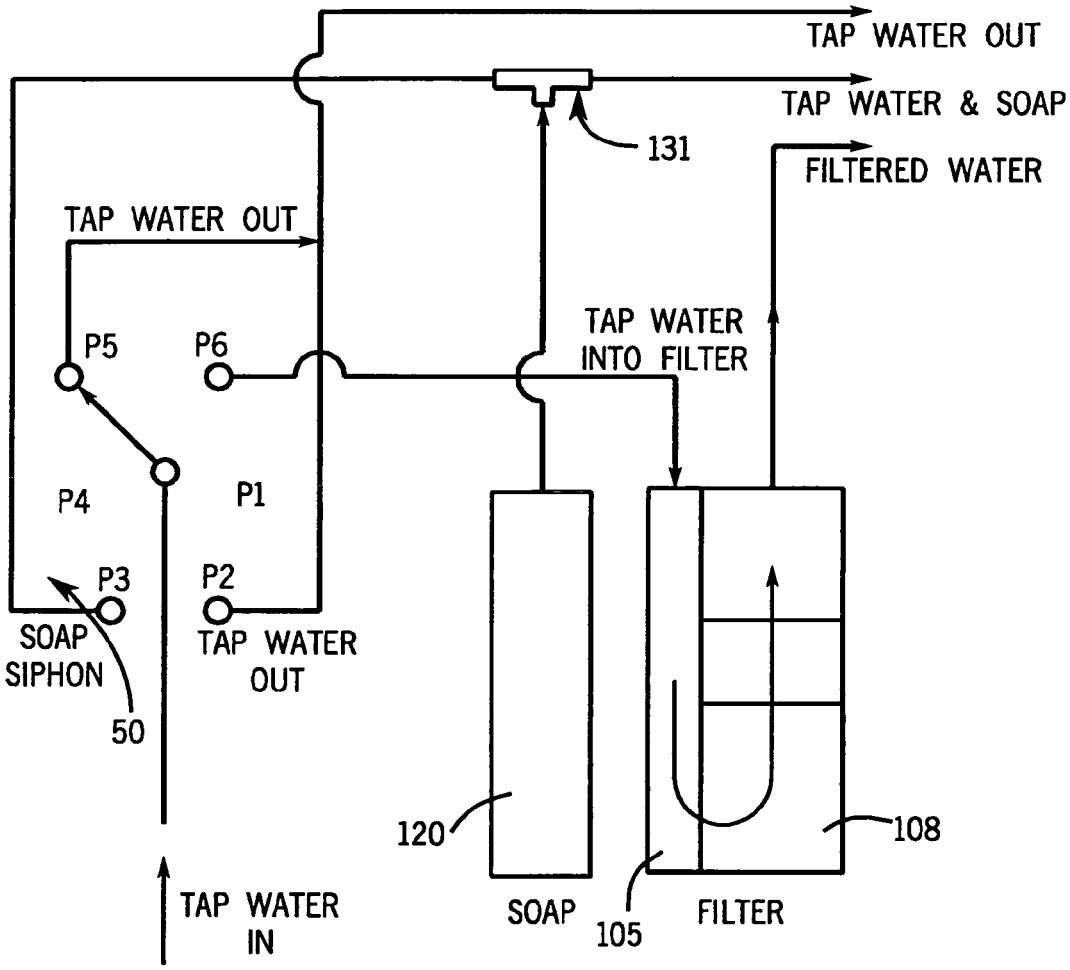
FIG. 18 is a schematic showing the fluid flow paths in the sprayer of FIG. 1.

Having described the construction of the sprayer 10, the fluid flow through the sprayer can be described with reference to the fluid flow schematic of FIG. 18. The flow selector 50 has six positions shown as P1, P2, P3, P4, P5 and P6 in FIG. 18. Indicia such as 0, 1, 2, 3, 4 and 5 can be placed in the top of the flow selector 50 to indicate these flow positions during use of the sprayer 10. Tap water from a garden hose is used as the example fluid.

When the flow selector 50 is in position P1, tap water enters carrier fluid coupling 19 from carrier fluid supply channel 18 and flows through the central hole 23 of the lower plate 22 into the oblong flow channel 32 and flow hole 33 of the flow diverter 28. However, when the flow selector 50 is in position P1, the flow diverter 28 is in a position where the upper end of the flow hole 33 is closed off by the lower surface 42 of the top plate 37 of the control valve 20. As a result, tap water does not move beyond the control valve 20.

When the flow selector 50 is in position P2, tap water enters carrier fluid coupling 19 from carrier fluid supply channel 18 and flows through the central hole 23 of the lower plate 22 into the oblong flow channel 32 and flow hole 33 of the flow diverter 28 as shown in FIG. 13. When the flow selector 50 is in position P2, the flow diverter 28 is in a position where the upper end of the flow hole 33 is placed in fluid communication with the first flow hole 44 of the top plate 37 of the control valve 20. As a result, tap water enters the tee coupling 71 that is in fluid communication with the conduit 72. The tap water flows in the conduit 72 to the coupling 73 on the nozzle mounting cap 78 (see FIG. 2). The tap water flows through the coupling 73 into the rinse fluid flow hole 81 of the nozzle mounting cap 78.

Then, depending on the position of the nozzle 88, the tap water flows through the rinse fluid flow hole 81 into either (i) the first rinse fluid orifice 96 of the nozzle to provide a stream of tap water from the nozzle 88 or (ii) the second rinse fluid orifice 97 of the nozzle to provide a fan spray of tap water from the nozzle 88. The user may then rinse off the surface being cleaned (e.g., a window). Looking at FIG. 13, it can also be seen that when the flow selector 50 is in position P2 as in FIG. 13, the third flow hole 46 is closed off by the lower surface 42 and the O-ring 36 of the top plate 37 of the control valve 20 to prevent tap water from entering the third flow hole 46 by way of the conduit 64.

When the flow selector 50 is moved into in position P3, tap water enters carrier fluid coupling 19 from carrier fluid supply channel 18 and flows through the central hole 23 of the lower plate 22 into the oblong flow channel 32 and flow hole 33 of the flow diverter 28. When the flow selector 50 is in position P3, the flow diverter 28 is in a position where the upper end of the flow hole 33 is placed in fluid communication with the second flow hole 45 of the top plate 37 of the control valve 20. As a result, tap water enters the coupling 67 that is in fluid communication with the conduit 68. The tap water flows in the conduit 68 to coupling 69 and into the aspirator 131 (see FIG. 15).

The tap water enters the aspirator 131 which draws chemical (e.g., soap) through the conduit 129 from the chemical housing 120 into the mixing chamber, where the chemical mixes with the stream of tap water. The tap water/soap solution from the aspirator 131 flows into the diluted chemical flow hole 79 of the nozzle mounting cap 78. Then, depending on the position of the nozzle 88, the tap water/soap solution flows through the diluted chemical flow hole 79 into either (i) the first diluted chemical orifice 94 of the nozzle to provide a stream of tap water/soap solution from the nozzle 88 or (ii) the second diluted chemical orifice 95 of the nozzle to provide a fan spray of tap water/soap solution from the nozzle 88. The user may then apply the tap water/soap solution to the surface being cleaned.

When the flow selector 50 is moved into position P4, tap water enters carrier fluid coupling 19 from carrier fluid supply channel 18 and flows through the central hole 23 of the lower plate 22 into the oblong flow channel 32 and flow hole 33 of the flow diverter 28. However, when the flow selector 50 is in position P4, the flow diverter 28 is in a position where the upper end of the flow hole 33 is closed off by the lower surface 42 of the top plate 37 of the control valve 20. As a result, tap water does not move beyond the control valve 20.

Figure 20:
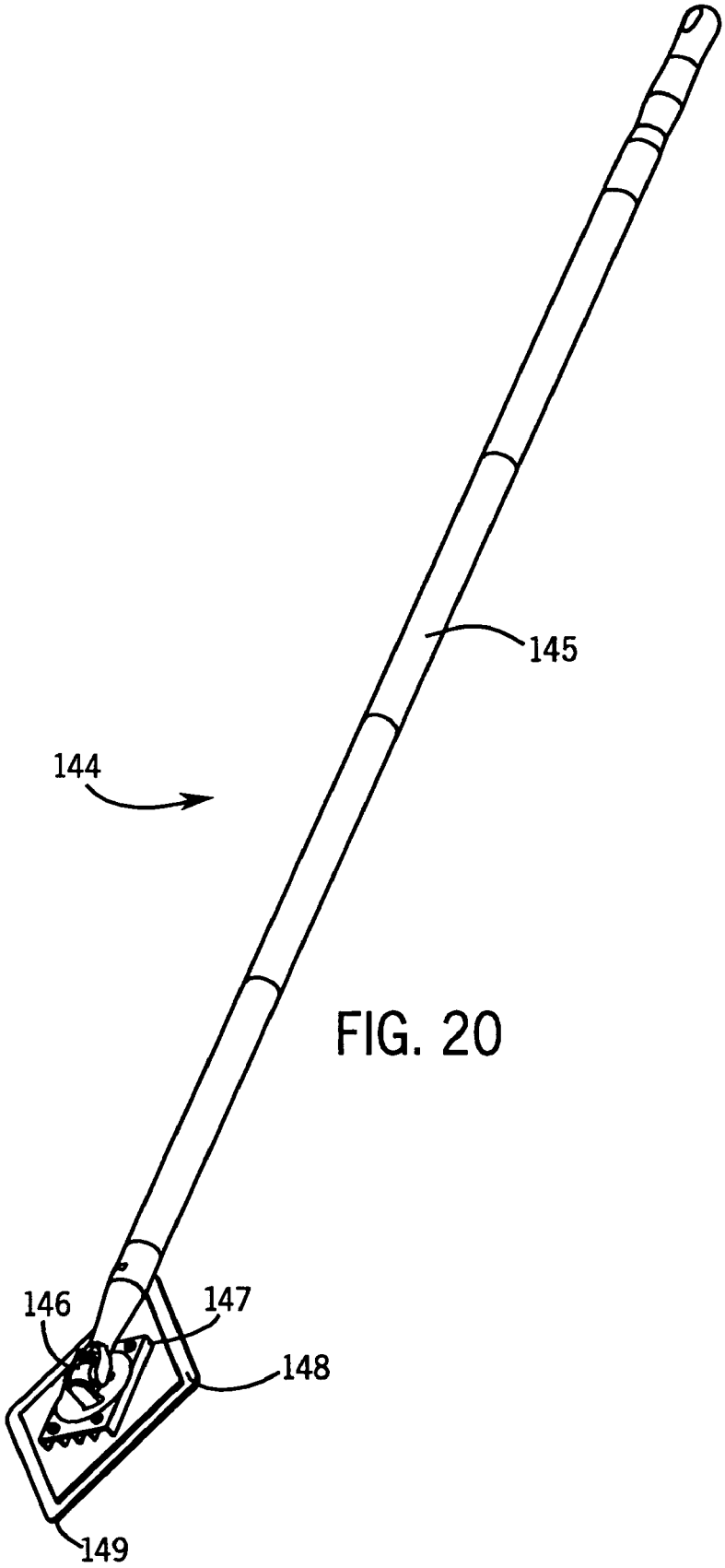
FIG. 20 is a perspective view of an expandable scrubbing tool suitable for use with a sprayer according to the invention.

At this time, a user places the sprayer 10 on a resting surface, and may optionally use a scrubbing tool 144 as shown in FIG. 20 for scrubbing the surface being cleaned. The scrubbing tool 144 includes a handle 145 for reaching high surfaces and a universal joint 146 that allows a mounting plate 147 to swivel in any direction. A scrubbing material 148 is affixed to the mounting plate 147 by suitable means such as a hook and loop type fastener commonly sold under the trademark Velcro™. The scrubbing material 148 may be configured in a diamond shape as in FIG. 20 to provide two opposite corners 149 having an acute angle (or two different acute angles) such that small corners of the surface being cleaned may be scrubbed with the corner 149 of the scrubbing material 148. Such a diamond shape also includes two opposed corners having an obtuse angle (or two different obtuse angles), and four straight sides connecting the corners. One example scrubbing material is a 0.25 inch thick sponge cloth with plastic fibers for scrubbing.

After scrubbing, the flow selector 50 is moved into position P5 in which tap water enters carrier fluid coupling 19 from carrier fluid supply channel 18 and flows through the central hole 23 of the lower plate 22 into the oblong flow channel 32 and flow hole 33 of the flow diverter 28. When the flow selector 50 is in position P5, the flow diverter 28 is in a position where the upper end of the flow hole 33 is placed in fluid communication with the third flow hole 46 of the top plate 37 of the control valve 20. As a result, tap water enters the coupling 65 that is in fluid communication with the conduit 64. The tap water flows in the conduit 64 through the tee coupling 71 and into the conduit 72.

The tap water flows in the conduit 72 to the coupling 73 on the nozzle mounting cap 78 (see FIG. 2). The tap water flows through the coupling 73 into the rinse fluid flow hole 81 of the nozzle mounting cap 78. Then, depending on the position of the nozzle 88, the tap water flows through the rinse fluid flow hole 81 into either (i) the first rinse fluid orifice 96 of the nozzle to provide a stream of tap water from the nozzle 88 or (ii) the second rinse fluid orifice 97 of the nozzle to provide a fan spray of tap water from the nozzle 88. The user may then rinse the tap water/soap solution off the surface being cleaned. Also, when the flow selector 50 is in position P5, the first flow hole 44 is closed off by the lower surface 42 and the O-ring 36 of the top plate 37 of the control valve 20 to prevent tap water from entering the first flow hole 44 by way of the coupling 71.

After rinsing soap off with tap water, the flow selector 50 is moved into position P6 in which tap water enters carrier fluid coupling 19 from carrier fluid supply channel 18 and flows through the central hole 23 of the lower plate 22 into the oblong flow channel 32 and flow hole 33 of the flow diverter 28. When the flow selector 50 is in position P6, the flow diverter 28 is in a position where the upper end of the flow hole 33 is placed in fluid communication with the fourth flow hole 47 of the top plate 37 of the control valve 20. Tap water then flows into conduit 76, through the fluid intake coupler 125 and into the fluid inlet coupling 103 of the cartridge 101 that provides a flow path to a fluid inlet 104 of the fluid intake channel 105 of the cartridge 101 (see FIG. 19). The tap water flows through the fluid intake passage 109 to the filter 108. In the filter 108, the tap water flows through the fluid intake section 110, the first separator 111, the first deionizing media section 112 (where cations are removed from the tap water), the second separator 113, the flow space 114, the third separator 115, the second deionizing media section 116 (where anions are removed from the tap water), the filter outlet 117 and into the filter outlet coupling 118.

The resulting deionized tap water then flows through the filter coupler 126 and conduit 141 to the coupling 142 on the nozzle mounting cap 78. Then, depending on the position of the nozzle 88, the deionized tap water flows through the filtered fluid hole 83 into either (i) the filtered fluid orifice 98 of the nozzle to provide a stream of deionized tap water from the nozzle 88 or (ii) the second filtered fluid orifice 99 of the nozzle to provide a fan spray of deionized tap water from the nozzle 88. The user may then rinse the surface being cleaned with deionized tap water. Rinsing with the deionized tap water serves to remove suspended and/or dissolved solids (cations and anions) and other contaminants (organic and inorganic) that may be present in tap water, particularly in regions with hard water. The flow selector 50 may then be moved back into position P1 for movement of the sprayer 10 to the next surface to be cleaned.

Having described the construction of the sprayer 10 and the various flow paths in the sprayer 10, a summary of a typical cleaning operation performed by a user can be provided. First, the user removes any protective seal from refill cartridge 101. Next, the door 135 of the sprayer cartridge compartment is opened and the cartridge 101 is installed as described above. The door 135 is then latched in the closed position. A garden hose is threaded to the coupling 17 to provide a tap water to the sprayer 10. The user optionally then places nearby the scrubbing tool 144 for use after application of cleaning chemical to the surface being cleaned.

Indicia may be provided on the housing 11 and/or the flow selector 50 for user convenience in identifying the operation being performed by the sprayer 10. In an example embodiment, the housing 11 has an indicia (such an arrow) at a "6 o'clock" position in relation to the rotatable flow selector 50 when viewed by the user. The flow selector 50 has an indicia such as "Off" or "0", and before turning on hose water at the tap, the user ensures that the flow selector 50 is positioned such that the "Off" or "0" on the flow selector 50 aligns with the indicia at the "6 o'clock" position on the housing 11. This position of the flow selector 50 corresponds to position P1 as described above.

When ready, the user turns the flow selector 50 into position P2 described above. An indicia such as "Rinse 1" or "1" or "Step 1: Rinse" may be provided on the flow selector 50 for user convenience. In position P2, the "Rinse 1" or "1" or "Step 1: Rinse" on the flow selector 50 aligns with the indicia at the "6 o'clock" position on the housing 11. The surface being cleaned (e.g., window) is then rinsed with tap water. By rotating the nozzle 88, the tap water can either be streamed (to blast soil from window and sliding glass door tracks or remove spider webs) or fanned for an easier wider spray on glass.

Once the majority of dirt is rinsed off, the flow selector 50 is turned into position P3 described above. An indicia such as "Soap" or "2" or "Step 2: Soap" may be provided on the flow selector 50 for user convenience. In position P3, the "Soap" or "2" or "Step 2: Soap" on the flow selector 50 aligns with the indicia at the "6 o'clock" position on the housing 11. Soapy water is delivered to the window. By rotating the nozzle 88, the soapy water can either be streamed or fanned for an easier wider spray on glass.

With enough soapy water on the window, the flow selector 50 is turned into position P4 described above. An indicia such as "Pause" or "3" or "Off" may be provided on the flow selector 50 for user convenience. In position P4, the "Pause" or "3" or "Off" on the flow selector 50 aligns with the indicia at the "6 o'clock" position on the housing 11. This position on the flow selector 50 is about 180 degrees from the "0" or "Off" P1 position when viewed by the user. The user then optionally uses the scrubbing tool 144 to loosen soil that was not easily rinsed off earlier.

When scrubbing is complete, the user turns the flow selector 50 into position P5 described above. An indicia such as "Rinse 2" or "4" or "Step 3: Rinse" may be provided on the flow selector 50 for user convenience. In position P5, the "Rinse 2" or "4" or "Step 3: Rinse" on the flow selector 50 aligns with the indicia at the "6 o'clock" position on the housing 11. The surface being cleaned (e.g., window) is then rinsed with tap water. By rotating the nozzle 88, the tap water can either be streamed or fanned. Tap water is used to rinse down the soap and loosened dirt.

With all the dirt and soap off the glass, the user turns the flow selector 50 into position P6 described above. An indicia such as "Filtered Rinse" or "5" or "Step 4: Finisher" may be provided on the flow selector 50 for user convenience. In position P6, the "Filtered Rinse" or "5" or "Step 4: Finisher" on the flow selector 50 aligns with the indicia at the "6 o'clock" position on the housing 11. The tap water is diverted through the filter 108 as described above to remove minerals from the water. The glass is rinsed long enough to ensure that all of the water used to rinse the soap has been removed.

Starting from the top of the window and moving back and forth down the window is preferred. After reaching the bottom of the window, starting a second time at the top of the window may be useful for best results. When done rinsing with filtered water, the user turns the flow selector 50 such that the "Off" or "0" on the flow selector 50 aligns with the indicia at the "6 o'clock" position on the housing 11, and the user can leave the window to air dry. Because there are no minerals in the final rinse water, no spots will result from the water drying. Since a user does not have to dry, the user can then immediately start cleaning the next set of windows. Thus, the sprayer 10 provides a clean, clear and spot free finish to exterior surfaces via drying by air.

Thus, there has been provided a sprayer particularly suitable as a hose-end sprayer. Untreated water can be used to first rinse the object to be washed, such as a window. By turning a control valve, the sprayer can be set to spray a mixture of soap and water. The control valve can be turned further to rinse the object with untreated water, and the control valve can be turned further to rinse the object with filtered tap water produced by a filter in the sprayer.

The sprayer has many advantages including, without limitation, (1) the sprayer uses a single refill cartridge for both the water filter and the cleaning chemical, typically surfactant; (2) the sprayer has the ability to deliver rinse water, a surfactant/water solution, and filtered water to the second or third story of a building making the sprayer particularly suitable for cleaning residential building windows; (3) the sprayer includes filters that reduce ion exchange resin expense and in one form may be replaced after one use to clean an average size house; (4) the sprayer includes a consumer intuitive control knob that, in one form, rotates consistently clockwise throughout the cleaning operation; (5) the sprayer includes a consumer intuitive control knob that, in one form, is located on the top of the sprayer such that when in use, the knob may be seen at a glance by the user; (6) the sprayer has a rotatable nozzle that provides for a stream or fan spray option for delivering the rinse water, soap/water solution and filtered water to the surface being cleaned; (7) the single refill cartridge does not require a use up cue for the filter because when the soap depleted, the water filter is automatically replaced with along the soap in a single cartridge; (8) the soap is installed in the sprayer in an easy to replace cartridge that does not require pouring soap into a separate compartment; and (9) the control knob may contain indicia such as "0, 1, 2, 3, 4, 5" or "Step 1, Step 2, Step 3, Step 4" that indicate to a user the steps in the cleaning process.

Although specific embodiments of the present invention have been described in detail, it should be understood that this description is merely for purposes of illustration. Many modifications and variations to the specific embodiments will be apparent to those skilled in the art, which will be within the scope of the invention. Therefore, the invention should not be limited to the described embodiments. Rather, the claims should be looked to in order to judge the full scope of the invention.

INDUSTRIAL APPLICABILITY

A hose end sprayer is disclosed which is suitable to deliver untreated rinse water, a cleaning solution, and then a filtered rinse water. Methods for using the sprayer are also disclosed.

The invention claimed is:

1. A sprayer for cleaning a surface, the sprayer comprising:

a carrier fluid supply channel;

a control valve in fluid communication with the carrier fluid supply channel;

a mixing channel in fluid communication with the control valve;

a housing suitable to contain a chemical to facilitate cleaning of the surface, the housing being in fluid communication with the mixing channel such that a flow of carrier fluid through the mixing channel can mix the chemical into the carrier fluid if carrier fluid passes through the mixing channel and the chemical is in the housing;

a rinse fluid channel in fluid communication with the control valve; and a filtered fluid channel in fluid communication with the control valve;

wherein the control valve has a flow selector that is configured such that, if the carrier fluid supply channel is linked to a carrier fluid supply, rotation of the selector in a single direction can selectively supply the carrier fluid to the mixing channel, or to the rinse fluid channel, or to the filtered fluid channel, or to none of the mixing channel, rinse fluid channel, and filtered fluid channel; and wherein the flow selector is configured such that if the carrier fluid supply channel is linked to a carrier fluid supply rotation of the selector in a single direction can selectively and sequentially supply the carrier fluid to none of the mixing channel, rinse fluid channel and filtered fluid channel in a first position, then to the rinse fluid channel in a second position, then to the mixing channel in a third position, then to none of the mixing channel, rinse fluid channel and filtered fluid channel in a fourth position, then to the rinse fluid channel in a fifth position, and then to the filtered fluid channel in a sixth position.

2. The sprayer of claim 1, wherein the first and fourth positions are essentially 180 degrees rotationally apart from each other, and the second and fifth positions are essentially 180 degrees rotationally apart from each other.

3. The sprayer of claim 1 wherein the flow selector can rotate in a direction selected from the group consisting of clockwise and counterclockwise.

4. The sprayer of claim 1 wherein:

the flow selector is located on an upper surface of the sprayer;

the mixing channel, the rinse fluid channel and the filtered fluid channel are all in fluid communication with an outlet nozzle; and the outlet nozzle includes means for adjusting a spray pattern for at least one of the mixing channel, the rinse fluid channel and the filtered fluid channel.

5. The sprayer of claim 4 wherein the means for adjusting the spray pattern comprises at least one pair of orifices in the nozzle wherein one of the pair of orifices has an inner wall of greater diameter at a front wall of the nozzle compared to a back wall of the nozzle.

6. The sprayer of claim 1 wherein:

the mixing channel, the rinse fluid channel and the filtered fluid channel are in fluid communication with a nozzle; and the mixing channel, the rinse fluid channel, the filtered fluid channel, and the nozzle are dimensioned such that a fluid stream from the nozzle can reach at least three meters from the nozzle.

7. The sprayer of claim 1 wherein:

inlet hole in fluid communication with the carrier fluid supply channel, and a second plate having a first flow hole in fluid communication with the rinse fluid channel, a second flow hole in fluid communication with the mixing channel, a third flow hole in fluid communication with the rinse fluid channel, and a fourth flow hole in fluid communication with the filtered fluid channel;

wherein when the control valve is in the second position, the inlet hole and the first flow hole are in aligned relationship;

wherein when the control valve is in the third position, the inlet hole and the second flow hole are in aligned relationship;

wherein when the control valve is in the fifth position, the inlet hole and the third flow hole are in aligned relationship; and wherein when the control valve is in the sixth position, the inlet hole and the fourth flow hole are in aligned relationship.

8. A sprayer for cleaning a surface, the sprayer comprising:

a carrier fluid supply channel;

a control valve in fluid communication with the carrier fluid supply channel;

a mixing channel in fluid communication with the control valve;

a housing suitable to contain a chemical to facilitate cleaning of the surface, the housing being in fluid communication with the mixing channel such that a flow of carrier fluid through the mixing channel can mix the chemical into the carrier fluid if carrier fluid passes through the mixing channel and the chemical is in the housing;

a rinse fluid channel in fluid communication with the control valve; and a filtered fluid channel in fluid communication with the control valve;

wherein the control valve has a flow selector that is configured such that, if the carrier fluid supply channel is linked to a carrier fluid supply, rotation of the selector in a single direction can selectively supply the carrier fluid to the mixing channel, or to the rinse fluid channel, or to the filtered fluid channel, or to none of the mixing channel, rinse fluid channel, and filtered fluid channel;

wherein a filter is disposed in the filtered fluid channel, and a reservoir for the chemical and the filter are housed in a cartridge that is removable as a unit from the control valve;

wherein the reservoir and the filter may be removed and replaced with a refill cartridge comprising an unitary reservoir and filter by way of an opening in a bottom wall of the sprayer; and wherein the opening, an end of the reservoir, and an end of the filter, are covered by a door.

9. The sprayer of claim 8 wherein:

a chemical supply channel provides a flow path between the mixing channel and the reservoir;

the chemical is positioned in the reservoir;

a carrier fluid intake channel is positioned between the filter and the reservoir, the carrier fluid intake being located in a flow path of the filtered fluid channel upstream of the filter;

the reservoir has an outlet coupling for placing the reservoir in fluid communication with the chemical supply channel;

the filter has an outlet coupling for placing the filter in fluid communication with the filtered fluid channel;

the carrier fluid intake channel has an inlet coupling for placing the carrier fluid intake channel in fluid communication with the filtered fluid channel; and the reservoir outlet coupling, the filter outlet coupling, and the inlet coupling all open in a common direction.

10. The sprayer of claim 8 wherein the door has a lower surface structured for supporting the sprayer in a standing position.

11. The sprayer of claim 8, wherein the filter and the reservoir are cylindrical.

12. The refill of claim 8:

wherein the unit further comprises a carrier fluid intake channel positioned between the filter and the reservoir.

13. The refill of claim 12, wherein:

the reservoir has an outlet coupling;

the filter has an outlet coupling;

the carrier fluid intake channel has an inlet coupling; and the reservoir outlet coupling, the filter outlet coupling, and the inlet coupling are located adjacent one end of the unit.

14. The refill of claim 13, wherein the reservoir outlet coupling, the filter outlet coupling, and the inlet coupling are all positioned in a linear relationship with respect to each other.

* * * * *